US006123034A

United States Patent [19]

Moore

[11] Patent Number: 6,123,034

[45] Date of Patent: Sep. 26, 2000

[54] SELECTIVELY VARIABLE MODULAR SPACE SYSTEM WITH SHELVING

[76] Inventor: John C. Moore, P.O. Box 4787, Vail, Colo. 81658

[21] Appl. No.: 09/122,308

[22] Filed: Jul. 24, 1998

Related U.S. Application Data

[63] Continuation-in-part of application No. 08/655,419, May 30, 1996, Pat. No. 5,791,265.

[51] Int. Cl.[7] ..... A47B 45/00

[52] U.S. Cl. ..... 108/180; 211/194; 108/186

[58] Field of Search ..... 108/91, 181, 187, 108/186, 180, 153.1, 157.1, 157.13, 157.17, 158.11, 157.12; 312/265.4, 108, 111, 265.1; 211/188, 194, 181.1, 182

[56] References Cited

U.S. PATENT DOCUMENTS

| | | | |
|---|---|---|---|
| 403,168 | 5/1889 | Wood . | |
| 3,261,585 | 7/1966 | Constantini et al. . | |
| 3,419,319 | 12/1968 | Jentzen . | |
| 3,730,601 | 5/1973 | Misenheimer, III | 312/111 X |
| 4,117,783 | 10/1978 | Eckel et al. . | |
| 4,118,081 | 10/1978 | Barrientos . | |
| 4,147,395 | 4/1979 | Gale | 108/186 |
| 4,191,436 | 3/1980 | Cherry . | |
| 4,434,899 | 3/1984 | Rivkin . | |
| 4,706,824 | 11/1987 | Mercer et al. | 108/186 X |
| 4,774,792 | 10/1988 | Ballance . | |
| 4,846,078 | 7/1989 | Janson . | |
| 5,016,765 | 5/1991 | Leonardo | 211/194 X |

FOREIGN PATENT DOCUMENTS

| | | |
|---|---|---|
| 637235 | 12/1963 | Belgium . |
| 1 464 043 | 3/1967 | France . |
| 2403893 | 5/1979 | France . |
| 1121585 | 1/1962 | Germany . |
| 88 08 708 | 9/1988 | Germany . |
| 810752 | 3/1959 | United Kingdom . |
| 2137871 | 10/1984 | United Kingdom . |

*Primary Examiner*—Janet M. Wilkens
*Attorney, Agent, or Firm*—Seed I.P. Law Group

[57] ABSTRACT

A modular space system includes open-sided modular frames stacked together to form open-sided columns, the upper frames having the same width but smaller depth than that of the frames on which they rest, thereby enhancing stability. Shelving elements of varying, selected dimensions extend through guide openings in the frames or rest on upper surfaces of the frames to provide horizontal work and storage surfaces. Snap-on frames are selectively attached to the modular frames to provide support for a variety of accessories, including file folders and drawers.

2 Claims, 13 Drawing Sheets

SELECTIVELY VARIABLE MODULAR SPACE SYSTEM WITH SHELVING

CROSS-REFERENCE TO RELATED APPLICATION

This application is a continuation-in-part of U.S. patent application Ser. No. 08/655,419, filed May 30, 1996, now issued as U.S. Pat. No. 5,791,265.

FIELD OF THE INVENTION

The present invention relates generally to a space system such as for accommodating document files, books, business equipment, computer equipment including peripherals, photographs, and any number of other general miscellaneous items typically found in an office, or room in a home.

BACKGROUND OF THE INVENTION

As used herein, the term "space system" or "space unit" relates to a system or unit to be located in a room or any space, either in a domestic or office setting, which supports objects of great variety in a visible and organized manner. Probably the most frequently encountered space unit is a table onto which objects are displayed or placed for easy use and retrieval. Such tables typically are of fixed geometry and size, limiting their practical application and ability to provide a certain desired aesthetic effect.

A further conventional system for accommodating such things as document files, is to provide cabinets with sides, top and bottom, and sliding drawers or drawer sides which can swing open providing access to the interior space where items are located out of normal view. Not only are cabinets relatively heavy and bulky, they have preferred access points (e.g., doors and drawers) via which access to the interior can only be made. Moreover, when a number of such cabinets are utilized and located within a given room, it will be found that because of restricted manner of access to the interior of the cabinets, only a limited space arrangement of the cabinets exists, precluding efficient use of the room space. Still further, such filing cabinets are of fixed design offering only a limited flexibility in use which is namely to move the cabinets from one location to another, but otherwise not being able to change their given size and shape and side of accessibility.

There are other known units having variable constructional aspects providing more flexible utilization and space accommodation capabilities. Exemplary of such prior solutions to these problems is U.S. Pat. No. 4,117,783, MODULAR STORAGE UNIT, by L. B. Eckel et al. which although disclosing a modular support unit of some flexibility, is not completely satisfactory.

SUMMARY OF THE INVENTION

It is a primary aim and object of the present invention to provide an improved space system of considerable flexibility which can accommodate a selective range of different typical personal and business files, books, and equipment and at the same time conform to a wide range of available room space configurations, including areas with limited wall space.

In accordance with another object, there is provided a system in accordance with the above object which includes open wall tubular modules of different sizes which can be vertically stacked onto one another forming columns and the columns interrelated by one or more shelving elements.

Another object is to provide a space system as in the previous objects including a plurality of modules of differing cross-sectional dimensions which can be selectively arranged in a number of stacked columns interrelated by shelving.

Yet another object of the invention is to provide a space system as in the previous objects including first modules for ground plane location, second modules for resting assembly on the first modules, said second modules being of reduced cross-sectional dimensions so as to increase system stability.

In accordance with a preferred embodiment of the invention, a first modular frame is provided constructed of individual rod-like elements interconnected to form a relatively rigid, generally parallelepiped construction. A second modular frame is similarly constructed to the first modular frame, with lower parts enabling stable resting receipt onto the top of an underlying first modular frame. The upwardly extending part of the second modular frame has reduced cross-sectional dimensions as compared to the first frame.

The first and second frame when mounted onto one another form a column having confining guide slots through which shelving elements are located. A third modular frame is generally rectangular with a pair of opposite edges located out of the plane of the remainder for receipt onto the top of an uppermost first or second frame to provide guide slots for topmost shelving between adjacent modular columns.

In another aspect of the invention, sets of the different modular frames are made in different cross-sectional dimensions (e.g., 12, 16, and 24 inches square), separate columns being stacked from like dimensioned modular frames and the various columns being related by shelving.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
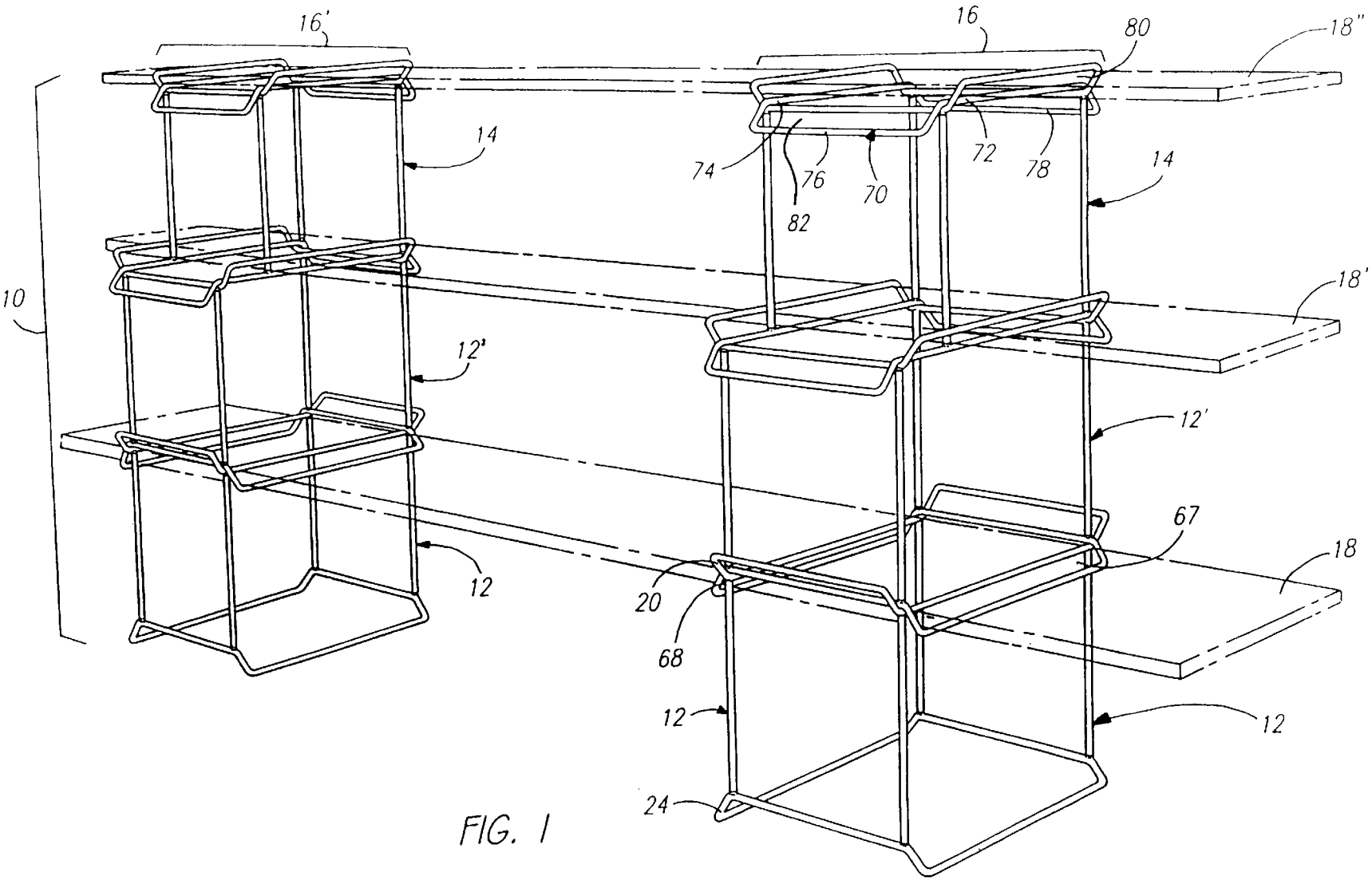
FIG. 1 is a perspective view of one version of space system of the present invention.

In the ensuing detailed description of a preferred embodiment of the invention, reference is made to the drawing and initially particularly to FIG. 1. As shown there, the system 10 to be described includes a plurality of first and second open-sided modular frames 12 and 14, respectively, assembled together to provide a number of separate columns 16, 16' for example, the lowermost modular frame resting on a suitable ground plane (e.g., floor) which is not shown. Moreover, in a way that will be more particularly described, one or more shelving elements 18, 18', 18", removably interrelate two or more columns, which shelving elements can support and display a miscellany of equipment, files, books or other objects on an upwardly directed surface.

Figure 2:
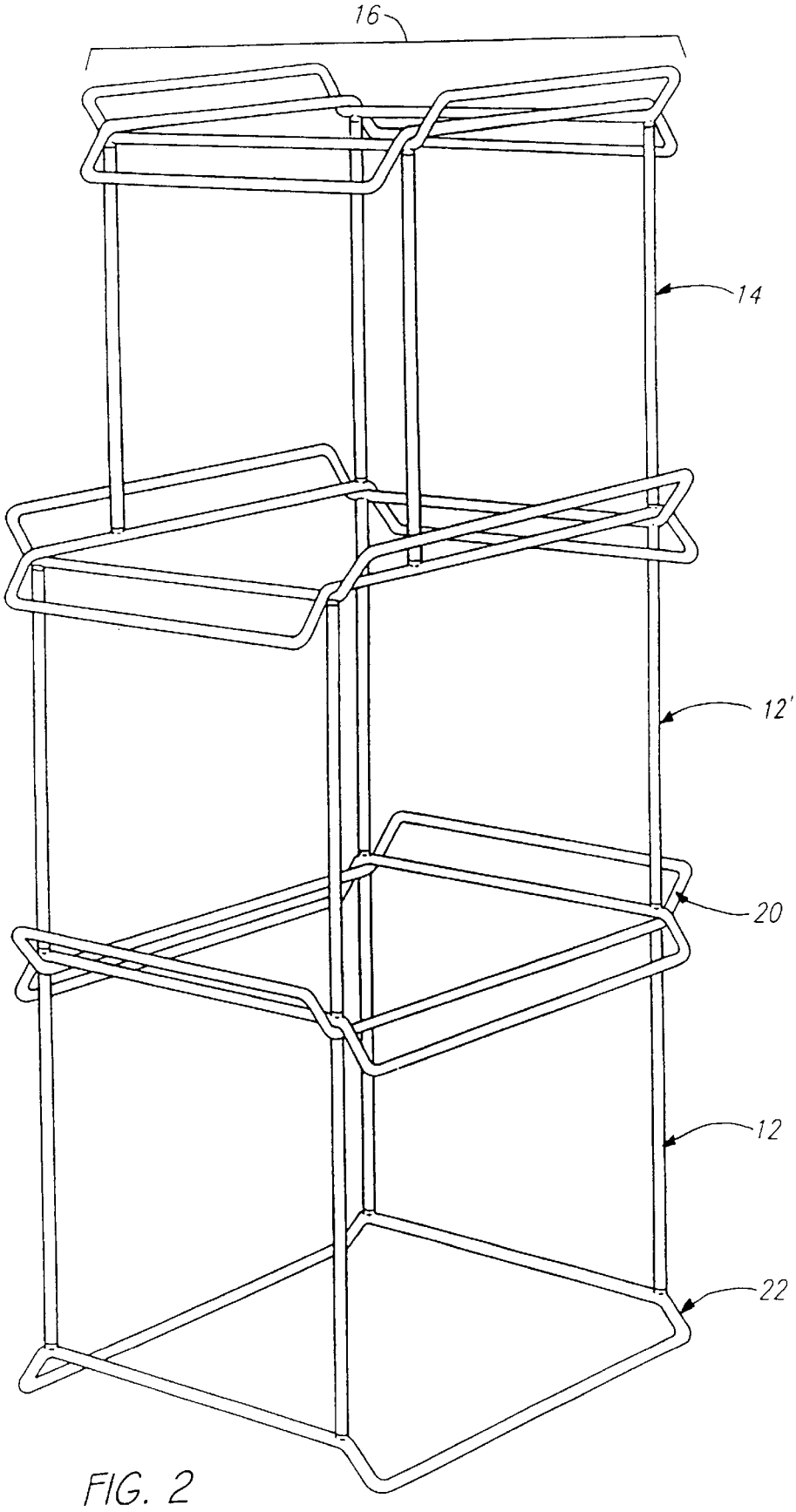
FIG. 2 is a perspective view of one form of column of the present invention.
Figure 3:
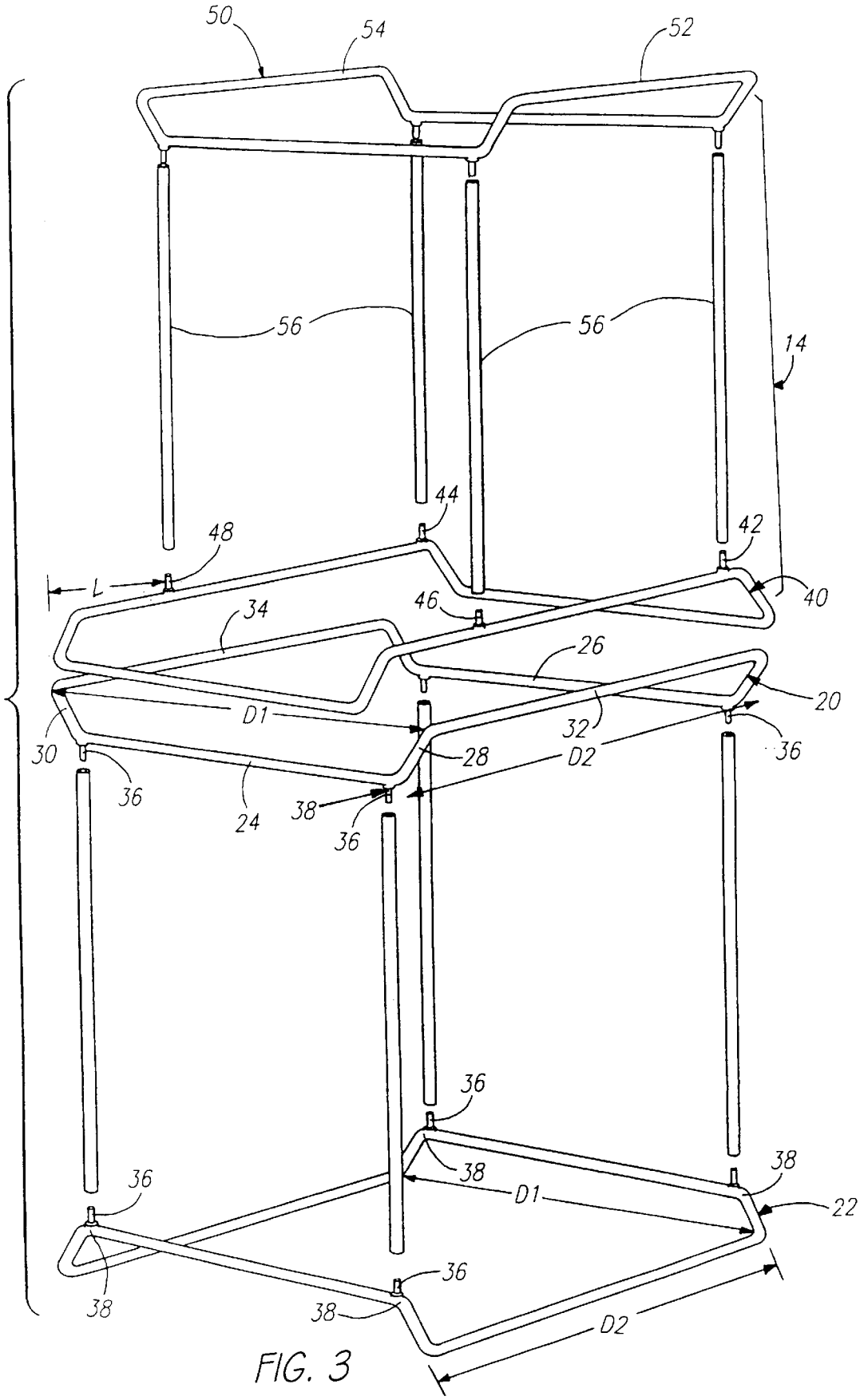
FIG. 3 depicts in exploded view two forms of modular frames of this invention.

With simultaneous reference to FIGS. 2 and 3, the first modular frame 12 is seen to include an upper base 20 and lower base 22, both of rectangular geometry and constructed from metal tubes or rods which form the outer sides of the bases. More particularly, the upper base 20 is constructed of a single tube or rod formed into first and second spaced-apart equilength parallel sides 24 and 26 which have end portions 28 and 30 that are bent upwardly at an angle to join third and fourth parallel base sides 32 and 34, respectively.

Accordingly, the base 20 has its sides 24, 26 forming a plane that is parallel to and spaced from the plane formed by the third and fourth sides 32, 34. Also, the third and fourth sides are spaced from one another a distance D1 that is greater than the spacing D2 between the first and second sides. When formed from a single rod or tube, the two opposite rod ends are preferably welded together (not shown) to form a rigid and strong closed-loop construction.

The lower base 22 is constructed the same as base 20 except that the bent end portions occur on the other opposed sides than in those of base 20. For example, if the end portions of the longer sides are bent on base 20, then the bent end portions will preferably occur on the shorter sides of base 22 (FIGS. 1 and 2).

A stub shaft 36 is welded at each of the approximate four corner points 38 of the bases 20 and 22 where the bending is accomplished to provide the end portions 28 and 30, only extending in a direction opposite to that of the bent portions (FIG. 3).

In assembly of a modular frame 12, four identical support tubes 39 (or optionally rods having a shallow axial opening in each end) have their ends received onto the stub shafts 36 of facing upper and lower bases 20 and 22 to form the overall parallelepiped form of the modular first frame 12.

Figure 5:
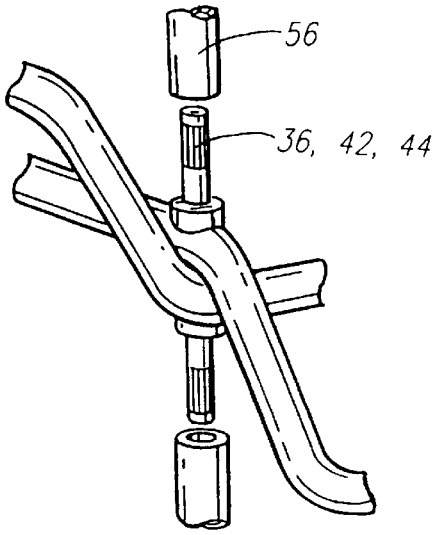
FIG. 5 is an enlarged, partially fragmentary, detailed view of contact areas for two stacked modular frames.
Figure 6:
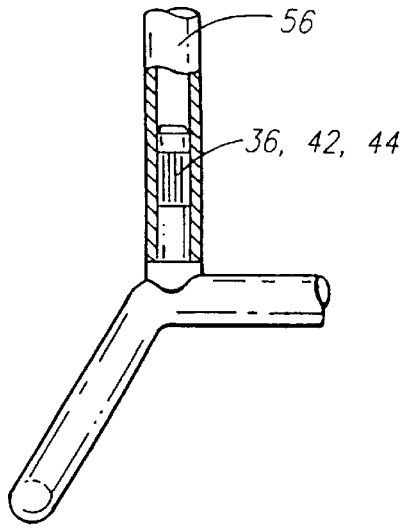
FIG. 6 is a sectional, partially fragmentary view of a support tube assembled to a modular frame.

The second modular frame 14 is constructed with an eye toward being restingly mounted onto the upper base 20 of a first modular frame 12 in a relatively stable configuration. The second frame lower base 40 should be constructed of geometry and dimensions identical to the first frame lower base 22 except that whereas two stub shafts 42 and 44 are located at bending points of one base side, the remaining two stub shafts 46 and 48 are positioned inwardly from the pair of bending points of the opposite side a predetermined distance L. The second frame upper base 50 is constructed identically to the first frame upper base 20 except that its sides 52 and 54 are of reduced length permitting assembly via vertical support tubes 56 having their lowermost ends received onto stub shafts 42–48, as further illustrated in FIGS. 5 and 6.

It is important to note that the lower base 22 of frame 12 has its bent end portions extending downwardly so that the frame 12 is resting on a ground plane solely on two opposite sides with the other two intervening sides being held spaced from the ground plane. On the other hand, the upper base 20 of frame 12 has its bent end portions extending upwardly away from the lower base 22. Similarly, the lower base for each modular frame 14 has its bent end portions extending downwardly while the upper base bent arm portions extend upwardly. These aspects of the two modular frames are maintained throughout the various frame assemblies to be described below.

With reference once again to FIG. 2, there is depicted a single column 16 including a first modular frame 12 resting on a ground plane (not shown), and a further first frame 12' having its lower base resting on the upper base of frame 12. Also, it is to be noted that bent portions of the lower base of frame 12' extend downwardly and outwardly of the upper base for frame 12, while at the same time the bent end portions of the frame 12 upper base extend upwardly about the sides of the lower base of frame 12'. This arrangement results in a locking condition of the two frames against either relative rotation or relative translation of the frames, although the two frames may be readily lifted apart.

Finally, a second modular frame 14 is restingly located on the upper base of frame 12' in the same way as just described in connection with the assembly of frame 12' onto frame 12. In addition to the locking action against relative rotation and translation for the three-frame column of FIG. 2, since the uppermost frame 14 is of reduced cross-sectional dimensions, the columnar structure is more stable than if the dimensions were equal to those of the underlying frame.

Figure 4:
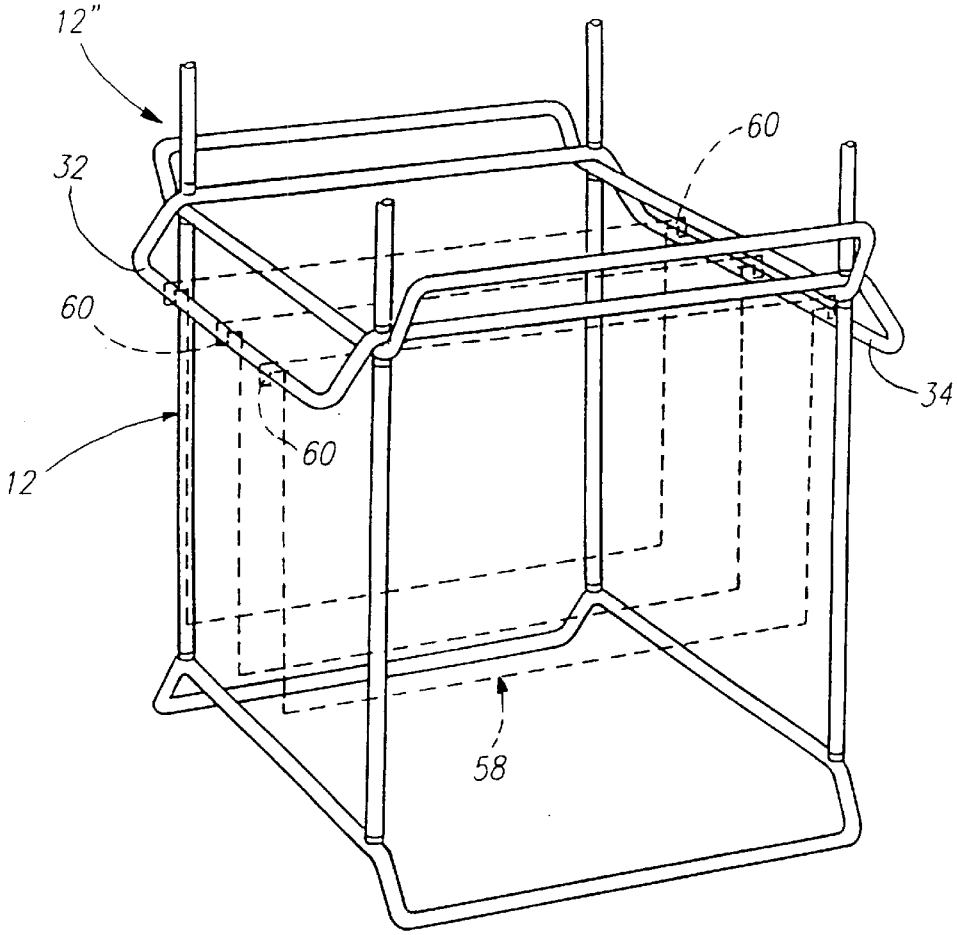
FIG. 4 shows in perspective, partially schematic, view utilization of a modular frame of this invention to support hanging files for documents.

FIG. 4 shows a pair of first modular frames 12 and 12" stacked in a column to be specifically used for maintaining hanging files 58. Hangers 60 on outer edges of the hanging files 58 hook onto the sides 32 and 34 of the lower base of an upper frame 12" and in that way locate files within the frame central space. File availability is primarily from the top with limited access from the sides.

Figure 7:
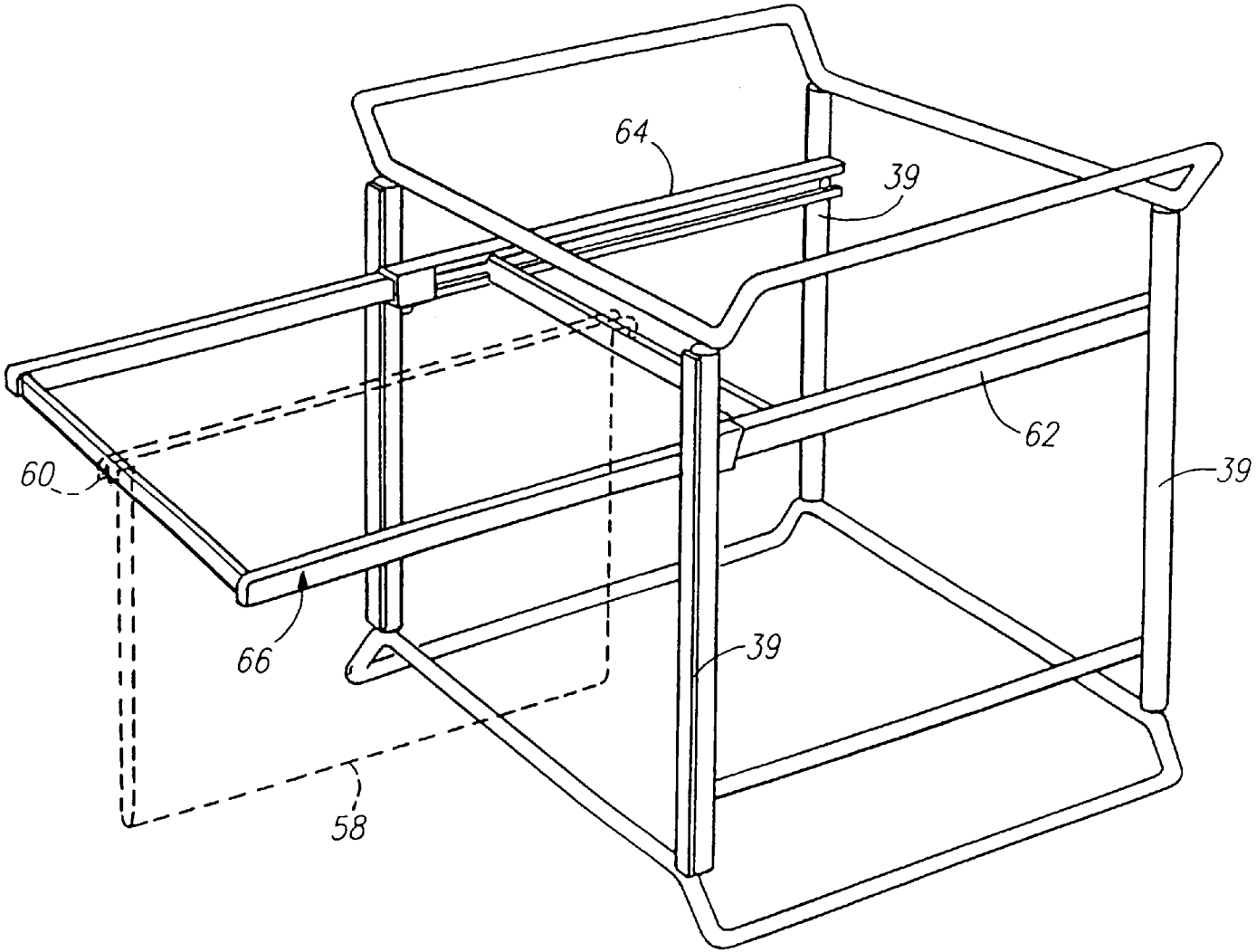
FIG. 7 is an isometric view of a modular frame utilized as a pull-out hanging file for documents.

FIG. 7 shows an alternative form of the system for accommodating hanging files 58, the latter being assumed identical to those hanging files depicted in FIG. 4 having edge hangers 60. In this version, first and second slide rails 62 and 64 are each secured to a pair of adjacent support tubes or rods 39 such that the two slide rails are parallel and spaced apart facing each other across the frame central space. An open center, generally rectangular carriage 66 is slidingly received within the rails 62 and 64 and is adjustable from a position fully within the frame central space, to a position substantially fully outside-frame 12 as shown in FIG. 7. The hangers 60 of each hanging file 58 hook onto opposite sides of carriage 66 as in the FIG. 4 embodiment.

Returning to FIG. 1, shelving elements 18, 18', 18" each consist of an elongated boardlike member of uniform thickness and width. When two first modular frames 12 and 12' are stacked on top of each other in a column the downwardly extending bent end portions of the lower base for 12' form a pair of aligned guide channels 67 and 68 through which a shelving element 18 can pass. Similarly, the shelving element can be received within guide channels in the further column 16'. Still further, the second modular frame 14 when stacked onto a first frame 12 or 12' provides similar guide channels for receiving shelving elements in the manner just described.

When it is desired to interrelate adjacent columns by a shelving element 18" extending at the level of the upper base of the uppermost frame (either 12 or 14), a further or third modular frame 70 is used. The latter frame is constructed of a single rod which has its ends welded together, and the so-formed closed loop is bent to provide a first pair of parallel sides 72 and 74 lying in one plane and a second pair of intervening parallel sides 76 and 78 lying in a common plane spaced from one side of the first plane. The third modular frame 70 is so dimensioned that when it is located on the upper base of a topmost frame 14 (e.g., FIG. 1) there are provided a pair of guide channels 80 and 82 for receiving a shelving element 18", for example.

Figure 8:
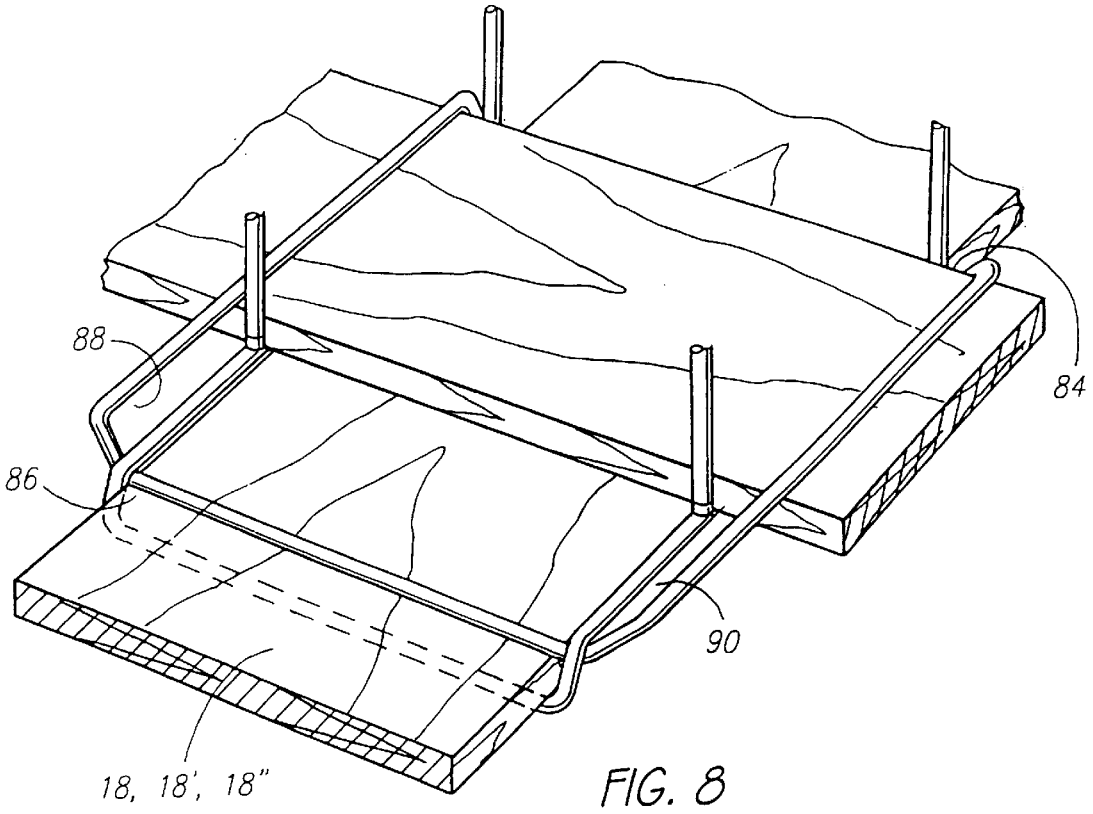
FIGS. 8, 9, and 10 depict isometric, first and second elevational views of shelving elements secured by and locking a pair of stacked modular frames together.
Figure 9:
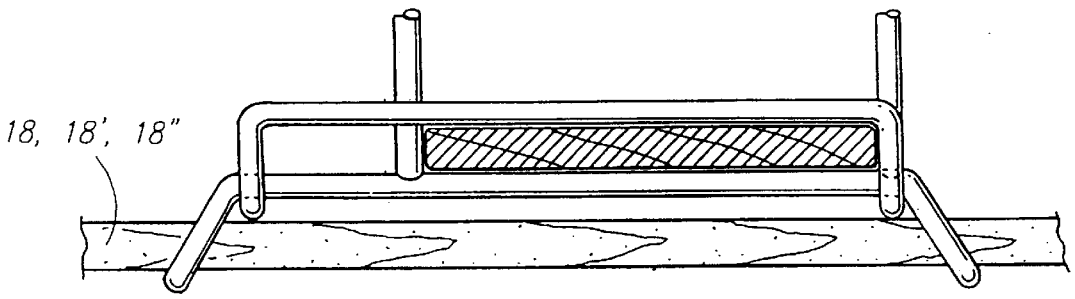
Figure 10:
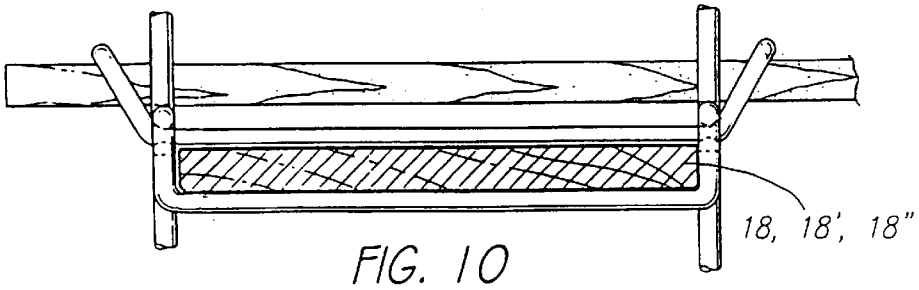

As shown in FIGS. 8-10, wherever a modular frame is assembled onto another modular frame there are two orthogonal sets of aligned guide channels which enable two vertically spaced shelving elements 18, 18', 18" to be secured to the assembled frames and extend at 90 degrees to each other. The pairs of channels are 84-86 and 88-90 (FIG. 8). This capability is especially advantageous where the described system must accommodate an inner corner of a room, for example, or it is otherwise desirable to provide an overall L-shape to the space system.

Figure 11:
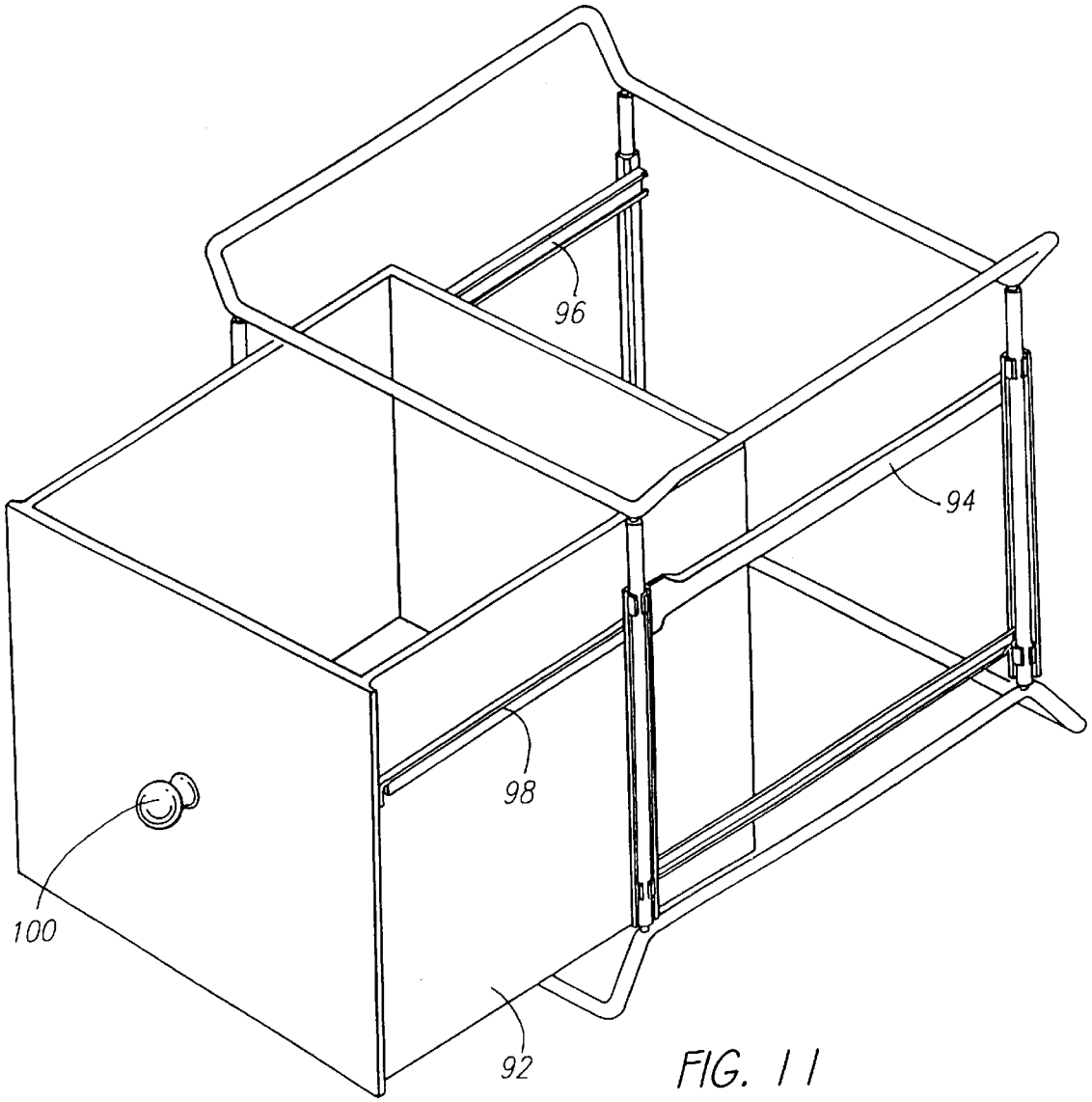
FIG. 11 is a perspective view of a modular frame adapted to include a drawer.

Turning now to FIG. 11 there is shown a first modular frame 12 modified to receive an open-top drawer 92 therein. More particularly, first and second slide rails 94 and 96 are secured to support tubes 39 on opposite sides of the frame which slidingly mate with respective slide inserts 98 on the two opposite outer sides of the drawer. The drawer may be slid into and out of the internal frame space by use of knob 100.

Figure 13:
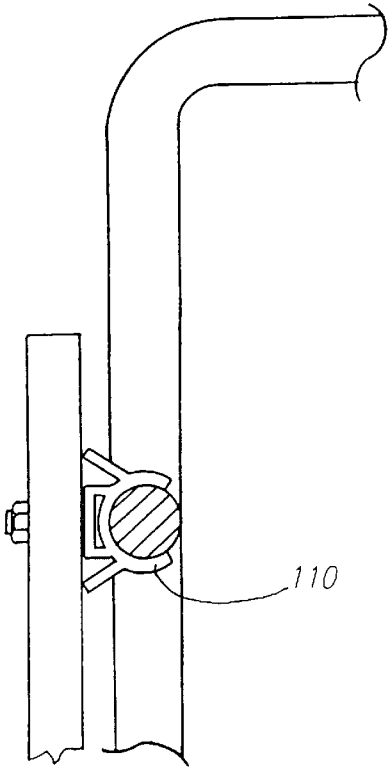
FIGS. 13, 14, and 15 depict elevational, partially sectional views of swinging door mounting means for the compartment of FIG. 12.
Figure 12:
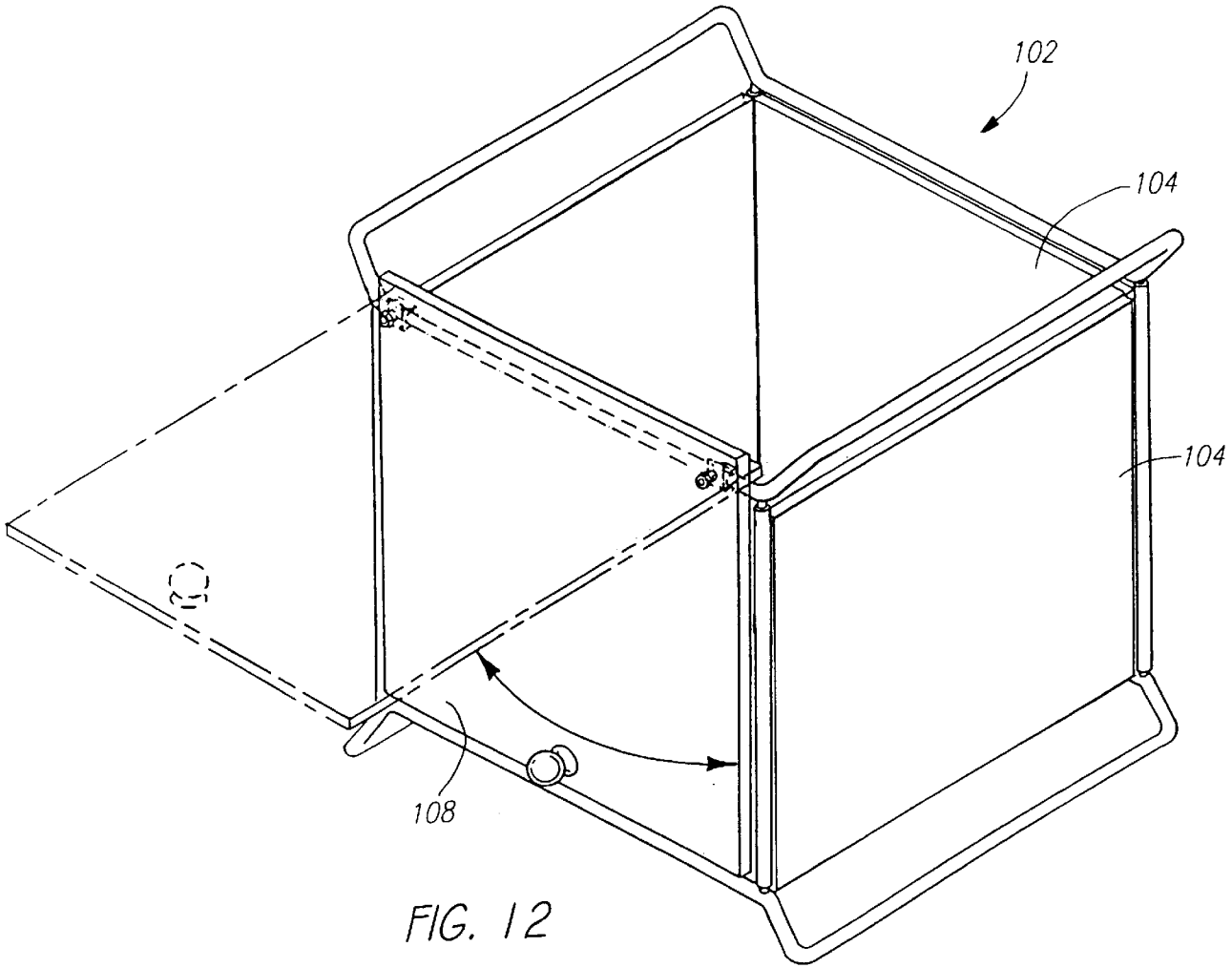
FIG. 12 is a perspective view of a modular frame adapted to provide a compartment with swinging door access.
Figure 14:
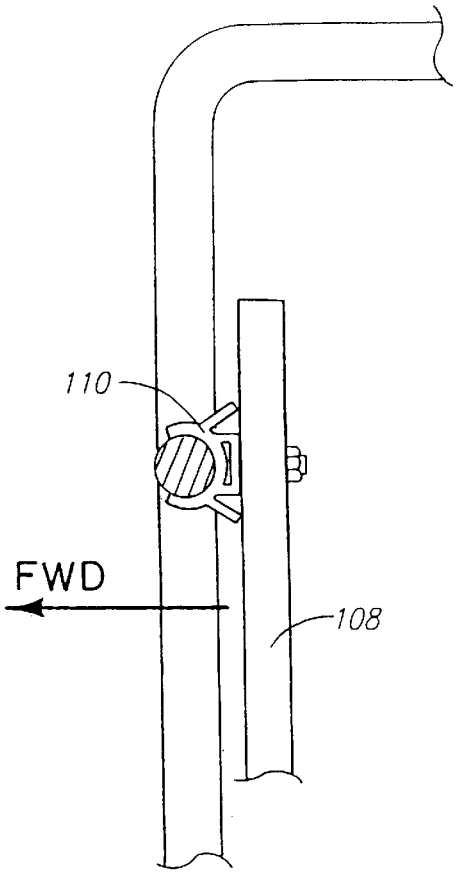
Figure 15:
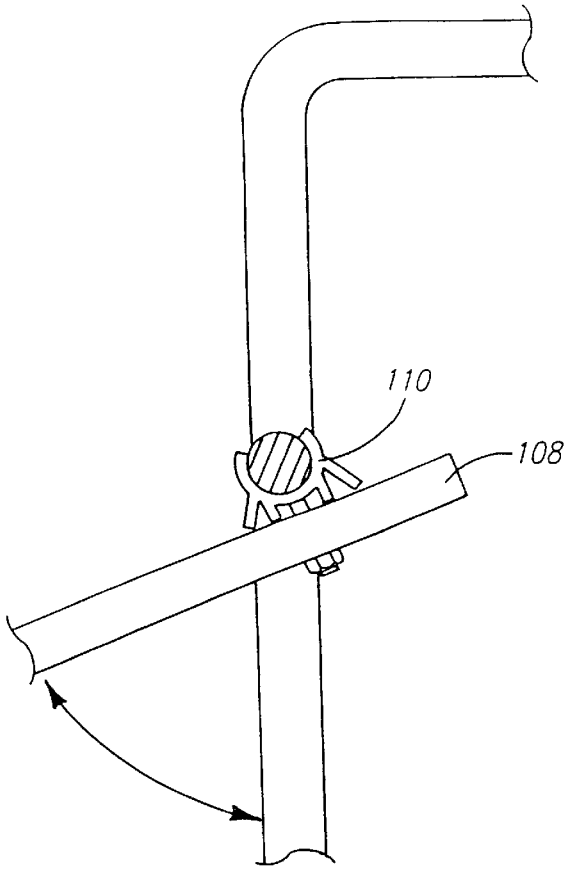

It may be desirable to utilize one or more modular frames as a closed compartment 102 as shown in FIG. 12. Sidewall 104 and bottom panels are removably secured to the base sides and support tubes by spring clips. The access side is closed off by a door 108 which is swingably mounted onto a modular frame upper base side by a pair of open-sided segmental spring clips 110. The clips may be either mounted on an inner surface of the door 108 (FIG. 13) or on its outwardly directed surface (FIGS. 14, 15).

Figure 16:
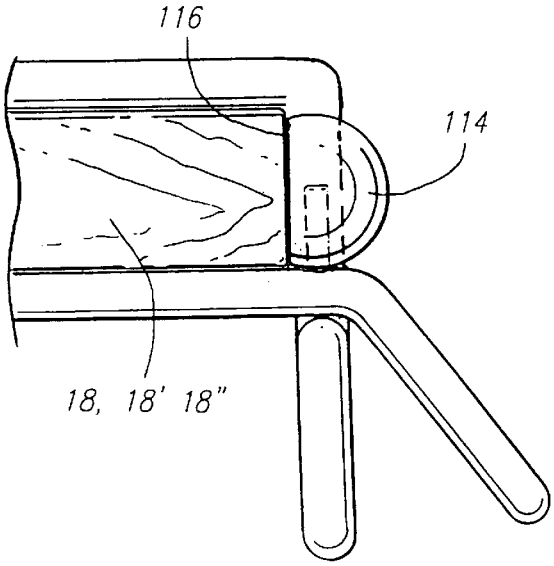
FIGS. 16 and 17 show in elevational view two forms of end finishings for receipt on the exposed end of a stub shaft.
Figure 17:
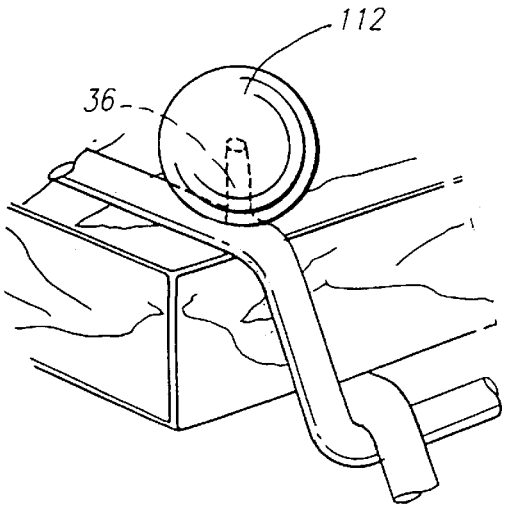

On reaching the topmost modular frame when building up a column of modular frames as described, there will be four upwardly extending stub shafts 36 left without associated support rods fitted thereon. FIG. 17 depicts a safety sphere 112 having an opening therein enabling fitting receipt onto the stub shaft. Where a shelving element 18, 18', 18" is located in obstructing relation so that a sphere 112 cannot be used, a semispherical element 114 includes an opening for fitting receipt onto the stub shaft 36 with a flat side 116 facing toward the shelving element (FIG. 16).

Figure 18:
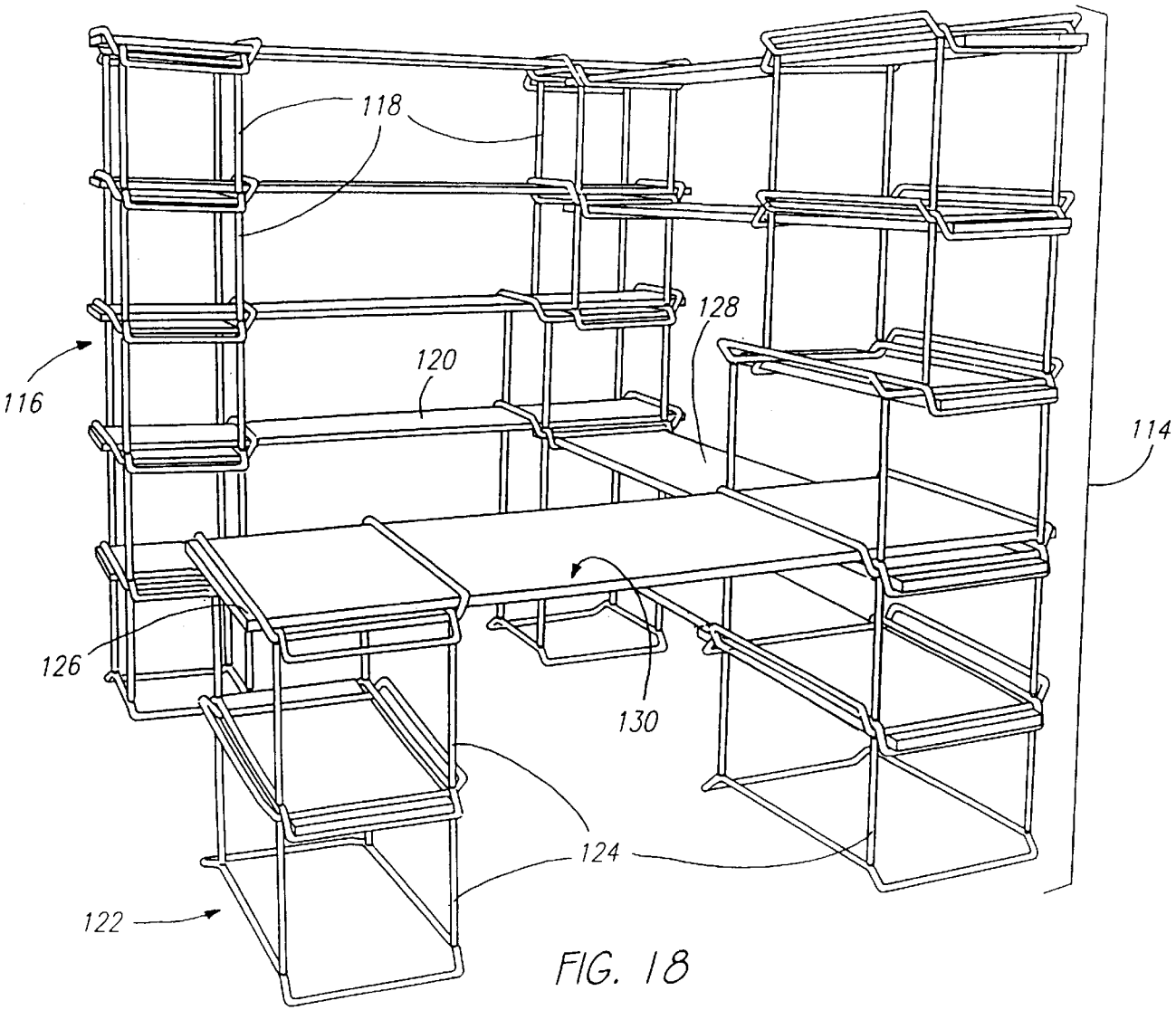
FIG. 18 is a perspective view of a system formed from individual columns of different dimensioned modular frames.

In the preceding description, it has been assumed that all modular frames 12 would be the same size. Also, although the modular frame 14 has an offset so that its cross-sectional dimensions are specified as less than those of the frame 12, the frames 14 have only been presented to this point as of a fixed single size. It is advantageous to make these modular frames in different-sized sets so as to enhance flexibility particularly by using different size modular frames in the same system. By way of significant example, reference is made to FIG. 18 where a generally U-shaped system 114 is shown. More particularly, one arm 116 of the system is constructed of modular frames 118 which are dimensioned to support a shelving element 120 that is 12 inches wide; the other arm 122 is constructed of modular frames 124 dimensioned to handle shelving elements 126 which are 24 inches in width; and shelving elements 128 of medium width (e.g., 16 inches) interconnecting the two arms.

The larger modular frames 124 can be used to form a desktop or relatively large tabletop surface 130 in view of the wide shelving element 126. The well of the desk is formed by leaving a space between adjacent columns in arm 122. The first arm 116 having the narrowest shelving elements can accommodate smaller objects, while the medium shelving 128 will accommodate modest sized objects (e.g., television, computer monitor). The entire assemblage may be extended along a single wall, adjacent a corner forming an "L", or centrally located in a room providing 360 degree access.

Figure 19:
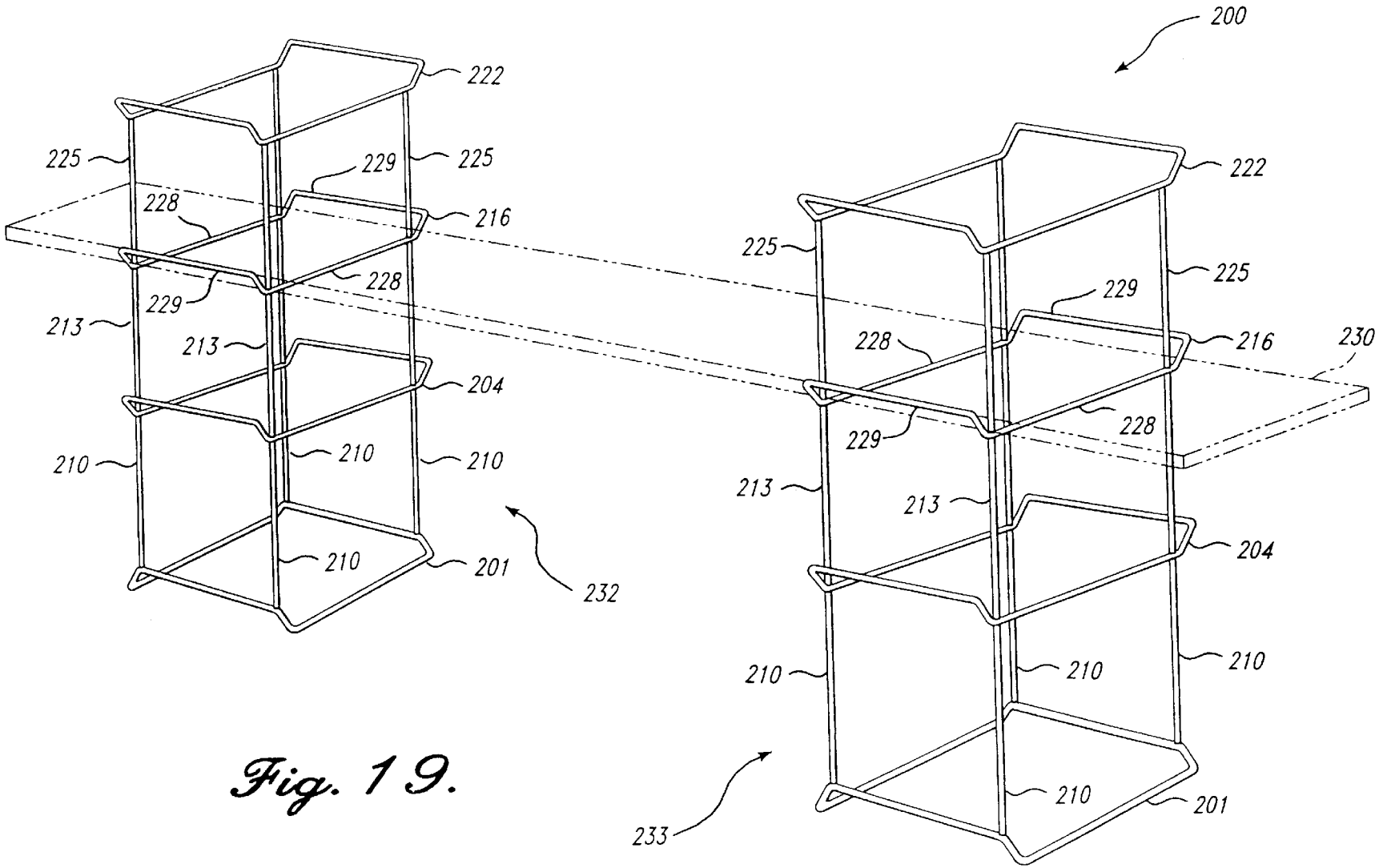
FIG. 19 is a front perspective view of an alternative embodiment of the present invention.
Figure 20:
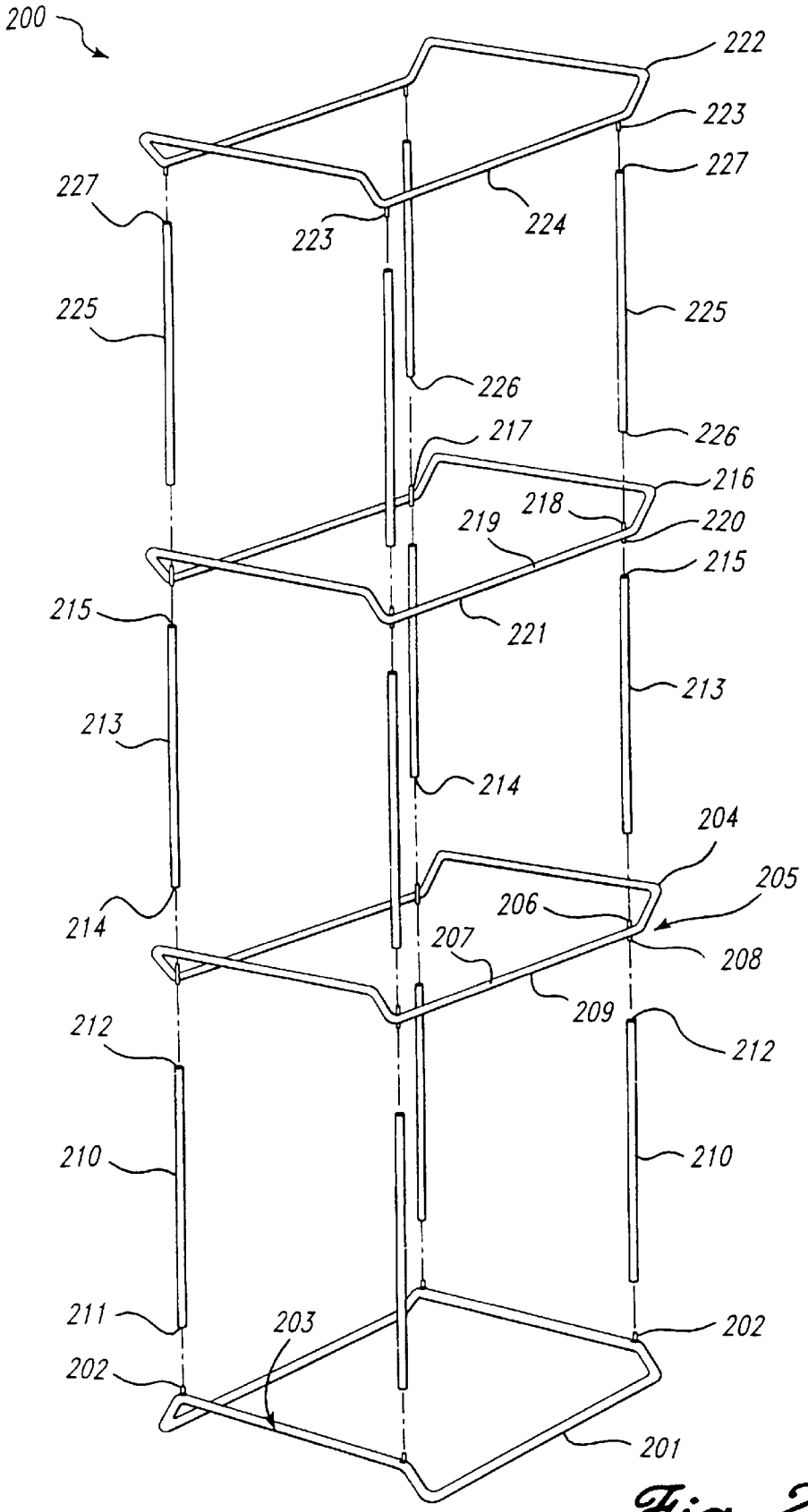
FIG. 20 is an exploded elevational view of the alternative embodiment illustrated in FIG. 19.
Figure 21:
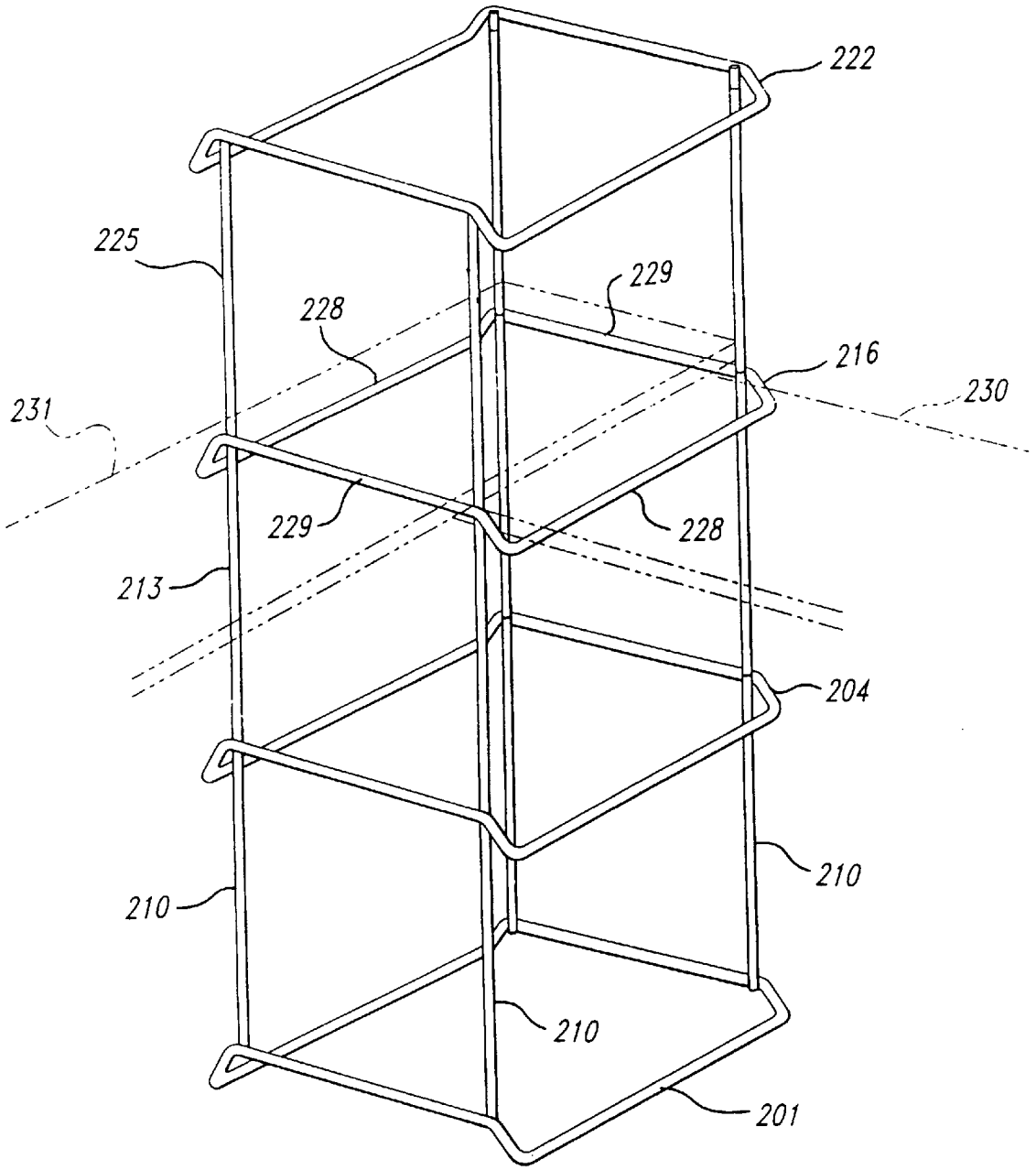
FIG. 21 is a perspective view of an alternative configuration of a preferred embodiment of the present invention.

In an alternative preferred embodiment of the present invention, as illustrated in FIGS. 19–21, a modular space system is provided having even greater flexibility of use, and reduced weight and cost. The space system is built up using single frames 201, 204, 216, and 222, coupled together and spaced longitudinally by spacers 210, 213, and 225. This is accomplished in accordance with a preferred embodiment of the present invention, as best seen in FIG. 20, by providing a first frame 201 having a plurality of first studs 202 extending above an upper surface 203 of the first frame 201. A second frame 204 is also provided, having a plurality of second studs 205. Each second stud 205 has a first portion 206 extending above an upper surface 207 of the second frame 204, and a second portion 208 extending below a lower surface 209 of the second frame 204. A plurality of first longitudinal spacers 210 couple the first lower frame 201 and the second frame 204 in longitudinally spaced relation to each other. The first longitudinal spacers 210 have a first open end 211 and a second open end 212, the first open end 211 receiving the first studs 202 and the second open end 212 of the spacers 210 receiving the second portion 208 of the second studs 205. By using a stud 205 that extends both above the upper surface of the frame and below a lower surface of the frame, it is possible to build both downward and upward from a single frame, without requiring the use of an additional frame.

A selected number of additional levels are built in a similar fashion. For purposes of illustration, as shown in FIGS. 19–21, and best seen in FIG. 20, a third frame 216 having a plurality of third studs 217 is coupled to the second frame 204 via a plurality of longitudinal spacers 213. Each of the third studs 217 has a first portion 218 extending above an upper surface 219 of the third frame, and a second portion 220 extending below a lower surface 221 of the third frame 216. Each of the second longitudinal spacers 213 has a first open end 214 and a second open end 215, the first open end 214 of the second longitudinal spacers receiving the first portion 206 of the second stud, and the second open end 215 of the second longitudinal spacers receiving the second end 220 of the third studs.

Although any desired number of levels may be built, in a preferred embodiment, a fourth frame 222 is provided, having a plurality of fourth studs 223 extending below a lower surface 224 of the fourth frame. A plurality of third longitudinal spacers 225 having a first open end 226 and a second open end 227 extend between the third frame 216 and the fourth frame 222. The first open end of the third longitudinal spacers 225 receive the first portion of the third studs 217, and the second open end 227 of the third longitudinal spacers 225 receive the fourth studs 223.

Therefore, if it is desired to only couple the frame to a longitudinal spacer in one direction, such as above the first lower frame 201 and below the fourth frame 222, the studs extend in only a single desired direction. However, when it is desirable to couple a frame both vertically upward and downward, the studs extend both above an upper surface and below a lower surface of the frame. Although the second studs 205 and the third studs 217 are illustrated as a single piece welded to an inner surface of their respective frames, it will be understood that the studs may be a single piece welded to an outer surface of the frames, or the studs may be two separate pieces, welded to the top and bottom surface of the frame, respectively.

As illustrated in FIG. 19, each of the first, second, third, and fourth frames 201, 204, 216, and 222 have a generally rectangular configuration, and have a first set 228 and second set 229 of parallel sides. When it is desired to create a work surface, for example at desk height, two columns 232 and 233 are constructed as described above. A board 230 having a selected width is placed on top of and supported by the upper surface of one of the sets of parallel sides of one of the first, second, third, and fourth frames. In the embodiment illustrated in FIG. 19, the board 230 is placed on the upper surface of parallel sides 228 of the third frame 216. The embodiment illustrated in FIGS. 19–21 has the advantage of providing a clean, unencumbered, continuous work surface along the length of the board, similar to a conventional table or desk, given that the frame 216 extends beneath the board 230, and there is no second frame extending across the top of the board 230 as shown in the other preferred embodiments illustrated in FIGS. 1–18. In addition, as discussed above, it is still possible to continue building upward above the level of the work surface created by board 230.

The embodiment illustrated in FIGS. 19–21 provides additional advantages when space is extremely limited, for example in a closet or small bedroom. More particularly, when constructing the modular space system illustrated in FIG. 19, the second frame 204 is coupled to the first frame 201 by placing the first frame 201 on the ground, positioning longitudinal spacers 210 on the first studs 202, and placing the second frame 204 into the second open ends 212 of the spacers 210. The system is further built up by placing longitudinal spacers 213 on the second studs 205 and positioning the third studs 217 of the third frame 216 in the second open end of the second spacers 213. The board 230 is then placed on top of the third frame 216, and the construction of the space system is continued by placing the third longitudinal spacers 225 onto the third studs 217, and building as many additional levels as is desired, by alternating longitudinal spacers and frames. By providing a system in accordance with this preferred embodiment of the present invention, the board 230 is placed directly on top of a frame, rather than being threaded through a guide channel created by two sets of stacked interlocking frames. It is therefore possible to build a space system in a confined area, where there would otherwise be insufficient space to maneuver the board sufficiently to insert it into a guide channel.

As further illustrated in FIG. 21, it is also possible to support two boards 230 and 231 by a single frame. A first board 230 is positioned on top of and supported by a first set of parallel sides 228 of one of the frames, for example frame 216. The second board is placed on top of and supported by the second set of parallel sides 229 of the same frame. In this manner, a corner unit is created that supports two boards, without requiring a frame to extend across a top surface of either of the boards. In this way, the complexity, and in turn the cost and weight of the system is reduced, while increasing the useable surface area and flexibility of the system. To further simplify manufacturing, the frames may be a flat square or rectangle, without having parallel sides bent upward or downward.

An improved modular space system has been shown and described. From the foregoing, it will be appreciated that although embodiments of the invention have been described herein for purposes of illustration, various modifications may be made without deviating from the spirit of the invention. Thus, the present invention is not limited to the embodiments described herein, but rather is defined by the claims which follow.

The embodiments of the invention in which an exclusive property or privilege is claimed are defined as follows:

1. A modular space system comprising:

a first frame having a generally rectangular configuration and having a first set of parallel side and a second set of parallel sides, the second set of parallel sides of the first frame being bent downward relative to the first set of parallel sides of the first frame;

a second frame having a generally rectangular configuration and having a first set of parallel sides and a second set of parallel sides, the second set of parallel sides of the second frame being bent downward relative to the first set of parallel sides of the second frame, the first and second frames being longitudinally spaced and coupled together by a plurality of first longitudinal spacers extending between the first and second frames; and a first board positioned on top of and supported by an upper surface of the second set of parallel sides of the second frame and a second board positioned on top of and supported by an upper surface of the first set of parallel sides of the second frame, the second board overlying the first board without touching the first board.

2. A modular space system comprising:

a first column having a first frame having a generally rectangular configuration having a first set of parallel sides and a second set of parallel sides, the second set of parallel sides being bent downward relative to the first set of parallel sides, a second frame having a generally rectangular configuration having a third set of parallel sides and a fourth set of parallel sides, the fourth set of parallel sides being bent downward relative to the third set of parallel sides, the first and second frames being longitudinally spaced and coupled together by a plurality of first longitudinal spacers extending between the first and second frames;

a first board positioned on top of and supported by an upper surface of the fourth set of parallel sides of the second frame and a second board positioned on top of and supported by an upper surface of the third set of parallel sides of the second frame, the second board overlying the first board without touching the first board;

a second column having a third frame having a generally rectangular configuration having a fifth set of parallel sides and a sixth set of parallel sides, the sixth set of parallel sides being bent downward relative to the fifth set of parallel sides, a fourth frame having a generally rectangular configuration having a seventh set of parallel sides and an eighth set of parallel sides, the eighth set of parallel sides being bent downward relative to the seventh set of parallel sides, the third and fourth frames being longitudinally spaced and coupled together by a plurality of second longitudinal spacers extending between the third and fourth frames; and the second column being substantially parallel to and spaced laterally from the first column, the second board being positioned on top of and supported by an upper surface of one of the seventh and eight sets of parallel sides of the fourth frame.

* * * * *

UNITED STATES PATENT AND TRADEMARK OFFICE

CERTIFICATE OF CORRECTION

PATENT NO. : 6,123,034
DATED : September 26, 2000
INVENTOR(S) : John C. Moore

It is certified that error appears in the above-identified patent and that said Letters Patent is hereby corrected as shown below:

Claim 1, column 8,
Line 9, "parallel side" should read -- parallel sides --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*